United States Patent [19]

Cates et al.

[11] Patent Number: 4,911,730

[45] Date of Patent: Mar. 27, 1990

[54] PROCESS FOR ENHANCING THE STRENGTH OF ARAMID FABRICS

[75] Inventors: Barbara J. Cates, Greensboro; Kevin S. Peele, Archdale; Patricia A. Schwartz, Greensboro, all of N.C.

[73] Assignee: Burlington Industries, Inc., Greensboro, N.C.

[21] Appl. No.: 225,791

[22] Filed: Jul. 29, 1988

[51] Int. Cl.[4] ..... D06P 5/00

[52] U.S. Cl. ..... 8/130.1; 8/115.6; 8/490; 8/925

[58] Field of Search ..... 8/130.1, 115.6, 490, 8/925

[56] References Cited

U.S. PATENT DOCUMENTS

| | | | |
|---|---|---|---|
| 3,475,207 | 10/1969 | Berch et al. | 127/143 |
| 4,240,795 | 12/1980 | Hendrix | 8/115.6 |
| 4,710,200 | 12/1987 | Cates et al. | 8/130.1 X |
| 4,749,378 | 6/1988 | Cates et al. | 8/130.1 |

OTHER PUBLICATIONS

*Textile Chemist and Colorist*, "Aminofunctional Polysiloxanes: A New Class of Softeners", M. M. Joyner, vol. 18, No. 3, Mar. 1986.

*Textile World*, "Cotton Crushproofing–Theory, Chemistry, Application", H. C. Borghetty et al., Dec. 1955.

*American Dyestuff Reporter*, "Some Variables in Improving the Crease Recovery of Cotton Fabrics with Synthetic Resins", A. C. Nuessel, Mar. 31, 1952.

*Primary Examiner*—Michael Lusignan

*Attorney, Agent, or Firm*—Nixon & Vanderhye

[57] ABSTRACT

Breaking and/or test strength of aramid fabrics are enhanced when finished with a fabric softener. Improvements of up to 50% over the corresponding untreated greige fabrics and up to 45% over the corresponding untreated dyed fabric are achieved without detracting from flame resistance of these fabrics.

13 Claims, No Drawings

PROCESS FOR ENHANCING THE STRENGTH OF ARAMID FABRICS

BACKGROUND OF THE INVENTION

Aramid fibers are made from high molecular weight polymers that are highly crystalline and have either a high or no glass transition temperature. They are highly resistant to heat decomposition, have inherent flame resistant properties and are frequently used in apparel and in protective clothing for special environments where their flame resistant properties are required. Fabrics made of aramid fibers for the protection of military personnel must meet minimum strength requirements as defined in MIL-C-83429A.

Processing and/or dyeing certain aramid fabrics, particularly with highly polar organic solvents, degrades the mechanical properties of these fabrics. Aramid fibers are available from the fiber producers as solution-dyed aramid yarn which is prepared by solution dyeing, in which a quantity of dye or pigment is mixed with the molten resin prior to extrusion of the resin into fine fibers. As an alternative to solution-dyed, manufacturer-supplied aramid yarns, fiber suppliers recommend a complicated exhaust dyeing procedure with a high carrier (acetophenone) content. A more recent aramid dyeing procedure is described in U.S. Pat. No. 4,525,168 in which acid or anionic dyes are introduced into aramid fibers by coupling the dye to a dye site receptor which, in turn, is attached to the fiber. The fiber is first swollen in a strong polar solvent and, while in the swollen condition, a substance capable of forming a strong chemical bond with the anionic dye is introduced.

Another procedure for dyeing specific aramids, namely poly(m-phenyleneisophthalamide) fibers, is described in commonly-assigned Cates et al U.S. Pat. No. 4,710,200. In this procedure, fibers of the meta isomer are swollen in an aqueous dye bath containing with the dye a significant quantity of a polar organic solvent swelling agent such as N-methylpyrrolidone, dimethylsulfoxide (DMSO) or dimethylacetamide.

While care is taken to avoid significant and objectionable loss of fiber strength, the polar organic solvents used in the dyeing procedures described above are notorious for damaging the fiber itself. Our invention restores fiber tearing strength and increases fiber breaking strength for dyed aramids up to 45%. Similarly, it is useful to increase the strength of undyed or greige aramid fibers to further enhance their already substantial tearing strength and breaking strength. Our invention increases tearing strength of greige aramid fabrics as well.

DESCRIPTION OF THE INVENTION

The relative tearing strengths and breaking strengths of aramid yarns and fabrics are improved when the yarns or fabrics are treated with lubricants or softening agents. Improved tearing strength is also imparted to fabrics made from blends of aramid fibers with other fibers, notably polybenzimidazole (PBI), using the process of this invention.

Lubricants and softening agents help the aramid fibers move in the direction of the stress, thus distributing the stress over a greater number of yarns. Since the effect of lubricants on tearing strength is physical, lubricants of different chemical composition are found to be effective, although to varying degrees. Lubricants may vary greatly in their effects on flame resistance or other properties of the treated textile. This invention obtains the stated improvements without harming the flame resistance of the aramid fabrics.

Several fabric softeners we have investigated have been found to be effective in increasing the strength of aramid fabrics. As a class, fabric softeners are traditionally used to impart improved hand and to remove harshness from fabrics without detracting from or unacceptably reducing other desirable properties of the fabric. They are applied in several ways as a finish to the fabric during textile processing operations. It is indeed surprising that a softening agent has such a pronounced and unexpected effect on a particular class of fibers and without harming the flame resistance of the fabrics.

A wide variety of textile softeners are suitable for this process, but the skilled operator must choose products which maximize improvement in strength without significantly diminishing the flame resistance of the treated products. The two softeners used in the examples which follow combine these desirable characteristics, and were chosen after a number of trials of candidate softeners. A wide variety of suitable softeners, including anionic, nonionic and cationic products will be found by the skilled operator among the following classes of softening agents:

Paraffin and tallow emulsions

Polyethylene emulsions of low, medium or high density, including oxidized polyethylenes Silicones of several types, including dimethyl silicones, methylhydrogen silicones and aminofunctional silicones Quaternary compounds, including dialkyl amine hydrochlorides Stearamides such as methylolstearamide Imidazolines Fatty acid esters of polyethylene glycol Polyethylene glycol esters Aramid fabrics are frequently used for their inherent flame resistant properties for special applications and for military clothing. Flame retardant-treated aramid fabrics having enhanced flame resistance are also successfully treated by the process of this invention. For those uses in which flame retardancy is a significant factor, care will be taken to select the appropriate softener or combination of softeners that provides the desired degree of strength enhancement to the fabric without affecting, or unduly reducing, the fabric's own inherent flame retardancy. A balance will be achieved by selecting the appropriate softener(s) guided by empirical results available. The experimental data that follows show no detrimental effect on flame resistance performance.

Strength enhancement is achieved by applying the softener or softener system (a combination of two or more softeners) to the fabric or yarn to be treated using any convenient means. We prefer a pad bath for its convenience and ease of control. The softener is preferably applied in amounts ranging from 0.1 to 10% by weight of the pad bath and usually in the 0.5 to 3% range depending upon the softener or softener system employed.

The invention provides a continuous process for enhancing the strength of both dyed (solution-dyed, conventionally-dyed and solvent-dyed fabrics) and undyed (greige) aramid fabrics without detracting from the inherent flame resistant properties of the fabric itself.

Fibers suitable for the strength enhancement process of this invention are known generically as aromatic polyamides or aramids. This class includes a wide variety of polymers as disclosed in U.S. Pat. No. 4,324,706, the disclosure of which is incorporated by reference. Experience indicates that the fibers amenable to the process of this invention are made from a polymer known chemically as poly(m-phenyleneisophthalamide), i.e., the meta isomer which is the polycondensation product of metaphenylenediamine and isophthalic acid. Below is a listing of fibers now commerciallY available identified by fiber name (usually trademark) and producer:

| Fiber Name | Producer |
|---|---|
| Nomex | DuPont |
| Apyeil (5207) | Unitika |
| Apyeil-A (6007) | Unitika |
| Conex | Teijin |

Blends of aramids with other fibers, including polybenzimidazole (PBI), may be subjected to the process of this invention.

In addition to carrier-dyed, solution dyed or greige aramid fabrics, the process of this invention is also suited to dyed flame retardant-treated aramid fabrics, for example those described in one or more of the following commonly-assigned U.S. patent applications: Ser. No. 870,523 filed July 4, 1986 now U.S. Pat. No. 4,759,770; Ser. No. 905,134 filed Sept. 9, 1986, now U.S. Pat. No. 4,741,740; and Ser. No. 906,380 filed Sept. 12, 1986, now U.S. Pat. No. 4,749,378.

The physical form of the fiber to be treated is open to wide variation. While most fibers treated will be in the form of a woven or knit fabric in open width—the form most adapted to processing operations—it is also possible to slasher treat the fibers in yarn form and then weave or knit the yarns into the item desired.

Testing procedures that were used in the examples are described in detail as follows:

FR Federal Test Method 5903 is intended for use in determining the resistance of cloth to flame and glow propagation and tendency to char. A rectangular cloth test specimen (70 mm×120 mm) with the long dimension parallel to the warp or fill direction is placed in a holder and suspended vertically in a cabinet with the lower end ¾ inch above the top of a Fisher gas burner. A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen continues to flame after the burner is extinguished. The time in seconds the specimen continues to glow after the specimen has ceased to flame is reported as afterglow time; if the specimen glows for more than 30 seconds, it us removed from the test cabinet, taking care not to fan the glow, and suspended in a draft-free area in the same vertical position as in the test cabinet. Char length, the distance (in inches) from the end of the specimen, which was exposed to the flame, to the end of a lengthwise tear through the center of the charred area to the highest peak in the charred area, is also measured. Five specimens from each sample are usually measured and the results averaged.

Limiting Oxygen Index (LOI) is a method of measuring the minimum oxygen concentration needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited from the top and the length of burning and the time are noted. The oxygen concentration is adjusted, the specimen is re-ignited (or a new specimen inserted), and the test is repeated until the lowest concentration of oxygen needed to support burning is reached.

Weight, count, tearing strength and air permeability were all measured before and after the equivalent of 15 home launderings as an approximation of usual garment use.

The invention is further explained with reference to the following examples in which all parts are percentages are by weight unless otherwise indicated. Examples identified by letter are comparative and not according to the invention.

EXAMPLES 1-4 AND COMPARATIVE EXAMPLE A

NOMEX® (DuPont) type 455 was continuously padded at 3 yards per minute in open width (60 inches) in a pad bath containing the specified concentration of BICD Softener OPC (a cationic polyethylene emulsion, Burlington Industries Chemical Division) at 20 psi at 20° C., then dried on a tenter frame oven at 280° C. for the required time. The greige fabric was not treated and is a control (Example A). The requirements for MIL-C-83429A are given in the left-hand column. The results are given in Table I, below.

TABLE I

| | Requirements MII-C-83429A | Control A T-455 S/57451 Greige Unfinished | 1 T-455 S/57451 Greige 0.5%* | 2 T-455 S/57451 Greige 1.5%* | 3 T-455 S/57451 Greige 3.0%* | 4 T-455 S/57451 Greige 4.0%* |
|---|---|---|---|---|---|---|
| Weight, oz/sq yd | 4.30 | 4.52 | 4.58 | 4.53 | — | 4.65 |
| after 15 la | | 4.87 | 4.81 | 4.88 | — | 4.81 |
| Width, in. | 60.00 | 59.75 | 59.88 | 59.75 | — | 60.00 |
| Count, warp | 70 | 70 | 69 | 70 | — | 69 |
| yarns/inch fill | 47 | 47 | 48 | 47 | — | 48 |
| after 15 la | | | | | | |
| warp | | 71 | 71 | 71 | — | 71 |
| fill | | 50 | 49 | 49 | — | 49 |
| Breaking Strength | | | | | | |
| "Grab" warp | 180 | 166.0 | 170.6 | 173.3 | — | 173.8 |
| (lbs) fill | 100 | 119.4 | 125.8 | 116.9 | — | 107.4 |
| after 15 la | | | | | | |

TABLE I-continued

| | Requirements MII-C-83429A | Control A T-455 S/57451 Greige Unfinished | 1 T-455 S/57451 Greige 0.5%* | 2 T-455 S/57451 Greige 1.5%* | 3 T-455 S/57451 Greige 3.0%* | 4 T-455 S/57451 Greige 4.0%* |
|---|---|---|---|---|---|---|
| warp | | 169.6 | 165.8 | 172.4 | — | 169.7 |
| fill | | 115.6 | 116.4 | 124.9 | — | 112.8 |
| Tearing Strength | | | | | | |
| (lbs) warp | 12.0 | 6.35 | 13.21 | 13.64 | — | 13.96 |
| fill | 8.0 | 4.69 | 9.48 | 9.60 | — | 9.59 |
| after 15 la | | | | | | |
| warp | | 7.77 | 11.93 | 12.20 | — | 11.75 |
| fill | | 4.65 | 7.60 | 7.80 | — | 7.05 |
| Air Perm, CFM/ft$^2$ | 25-160 | 101 | 101 | 101 | — | 97 |
| after 15 la | | 81 | 82 | 86 | — | 78 |
| LOI, % | — | 27.3 | 27.3 | 27.3 | 27.3 | 26.4 |
| FR, FTM 5903 warp × fill (orig) | | | | | | |
| AF (sec) | 2.0 × 2.0 | | 0 × 0 | 0 × 0 | 0 × 0 | 0 × 0 |
| AG (sec) | 25.0 × 25.0 | | 0 × 0 | 0 × 0 | 0 × 0 | 0 × 0 |
| CL (inch) | 3.5 × 3.5 | | 1.8 × 1.8 | 1.6 × 1.6 | 1.8 × 1.6 | 1.7 × 1.6 |

*% of softener in the pad bath

EXAMPLES 5-9 AND COMPARATIVE tion purposes. The color (when dyed) and lubricant (when used) are indicated below the style number.

TABLE II

| | Requirement MIL-C-83429A | 5 T-455 S/57451 Greige | B PT 14, T-455 S/57431 Khaki | 6 PT 14,T-455 S/57431 Khaki Chemical A | 7 PT 14,T-455 S/57431 Khaki Chemical B | C PT 14,T-455 S/57431 Sfty Yellow | 8 PT 14,T-455 S/57431 Sfty Yellow Chemical A | 9 PT 14,T-455 S/57431 Sfty Yellow Chemical B |
|---|---|---|---|---|---|---|---|---|
| Weight, oz/sq yd | 4.30 | 4.46 | 4.82 | 5.03 | 5.04 | 4.81 | 4.97 | 4.85 |
| Width, in. | 60.00 | 58.75 | 58.00 | 60.50 | 60.50 | 59.25 | 59.50 | 59.75 |
| Count, warp | 70 | 70 | 71 | 69 | 70 | 71 | 70 | 70 |
| yarns.inch fill | 47 | 47 | 46 | 49 | 49 | 47 | 47 | 47 |
| Breaking Strength | | | | | | | | |
| "Grab" warp | 180 | 179.4 | 167.3 | 174.2 | 175.5 | 172.7 | 172.3 | 171.7 |
| (lbs) fill | 100 | 133.1 | 120.1 | 134.8 | 131.6 | 123.4 | 130.0 | 119.3 |
| Tearing Strength | | | | | | | | |
| (lbs) warp | 12.0 | 8.1 | 6.6 | 11.99 | 10.87 | 6.9 | 11.27 | 10.87 |
| fill | 8.0 | 4.9 | 4.2 | 7.27 | 7.93 | 4.1 | 8.64 | 7.93 |
| LOI, % | — | | 36.7 | 38.0 | 37.5 | 39.3 | 38.2 | 38.0 |
| Fr, FTM 5903 warp × fill (orig) | | | | | | | | |
| AF (sec) | 2.0 × 2.0 | | 0 × 0 | 0 × 0 | 0 × 0 | 0 × 0 | 0 × 0 | 0 × 0 |
| AG (sec) | 25.0 × 25.0 | | 0 × 0 | 0 × 0 | 0 × 0 | 0 × 0 | 0 × 0 | 0 × 0 |
| CL (inch) | 3.5 × 3.5 | | 1.8 × 1.8 | 1.6 × 1.6 | 1.8 × 1.6 | 1.7 × 1.6 | 1.7 × 1.7 | 1.4 × 1.4 |

EXAMPLES B AND C

A procedure similar to the previous examples was followed. In example 5, 100% T-455 NOMEX was used; in the remaining examples 6-9 and comparative examples B and C a blend of 7% PBI and 93% T-455 NOMEX was used. Example 5 was undyed; examples B, 6 and 7 used khaki-colored fabric; examples C, 8 and 9 used safety yellow. Chemical A was BICD Softener 649 (a cationic emulsion of silicone and mixed hydrocarbons, Burlington Industries Chemical Division) applied from a 1.5% bath at 20 psi at 20° C. and dried on a tenter frame at 280° F. at a speed of 3 yards per minute. Chemical B was the same softener as in Example 4 applied from a 4% pad bath. The results are given in Table II below.

Grab breaking strength measurements were performed according to ASTM D1682-64. Air permeability measurements were performed according to ASTM D737-75, using the Frazier apparatus. Elmendorf tearing strength measured were performed according to ASTM D1424-83, using the Elmendorf apparatus. The s/ numbers are fabric style numbers used for identifica- Other embodiments of the invention in addition to those specifically described and exemplified above will be apparent to one skilled in the art from a consideration of this specification or the practice of the invention disclosed herein. It is intended that the specification and examples be considered as exemplary only, with the true scope and spirit of the invention being indicated by the claims that follow.

What is claimed is:

1. A process for enhancing the strength of an aramid fabric comprising applying to the aramid fabric a breaking strength and/or tearing strength-enhancing amount ranging from about 0.1% to about 10%, based on the weight of the solution applied, of a anionic, nonionic or cationic fabric softener selected from the group consisting of paraffin emulsions, tallow emulsions, polyethylene emulsions of low, medium or high density, silicones, quaternary compounds, stearamides, imidazolines, fatty acid esters of polyethylene glycol and polyethylene glycol esters such that the thus treated fabric has a breaking strength or a tearing strength at least 10% greater than that of the corresponding untreated fabric.

2. The process of claim 1 in which the breaking or tearing strength of the treated fabric is at least 20% greater than that of the corresponding untreated fabric.

3. The process of claim 1 in which the breaking or tearing strength of the treated fabric is at least 30% greater than that of the corresponding untreated fabric.

4. The process of claim 1 in which the Limiting Oxygen Index of the treated fabric is at least equal to that of the untreated fabric.

5. The process of claim 1 in which the aramid fabric contains up to 10% by weight of polybenzimidazole.

6. A process for enhancing the strength of a solution-dyed aramid fabric comprising applying to the fabric a strength-enhancing amount ranging from about 0.1% to about 10%, based on the weight of the solution applied, of a anionic, nonionic or cationic fabric softener selected from the group consisting of paraffin emulsions, tallow emulsions, polyethylene emulsions of low, medium or high density, silicones, quaternary compounds, stearamides, imidazolines, fatty acid esters of polyethylene glycol and polyethylene glycol esters such that the thus treated fabric has a breaking strength or a tearing strength at least 10% greater than that of the corresponding untreated fabric.

7. The process of claim 6, in which the breaking or tearing strength of the treated fabric is at least 20% greater than that of the corresponding untreated fabric.

8. The process of claim 6, in which the breaking or tearing strength of the treated fabric is at least 30% greater than that of the corresponding untreated fabric.

9. The process of claim 6, in which the Limiting Oxygen Index of the treated fabric is at least equal to that of the untreated fabric.

10. The process of claim 6, in which the aramid fabric contains up to 10% by weight of polybenzimidazole.

11. The process of claim 6, in which the aramid fabric also contains a flame retardant agent.

12. The process of claim 1, in which the fabric softener is added onto the fabric from a pad bath containing from about 0.5 to 4% fabric softener calculated on the weight of the pad bath.

13. The process of claim 6, in which the fabric softener is added onto the fabric from a pad bath containing from about 0.5 to 4% fabric softener calculated on the weight of the pad bath.

* * * * *